US005081716A

United States Patent [19]

Lehenbauer et al.

[11] Patent Number: 5,081,716

[45] Date of Patent: Jan. 21, 1992

[54] GARMENT WITH BIND-PREVENTING CROTCH CONSTRUCTION

[76] Inventors: Ruth B. Lehenbauer, 570 N. 600 East, Logan, Utah 84321; Lois Hugie, 183 N. Center, Hyrum, Utah 84319

[21] Appl. No.: 669,985

[22] Filed: Mar. 15, 1991

[51] Int. Cl.[5] ..... A41B 9/00

[52] U.S. Cl. ..... 2/78 B; 2/109; 2/400; 2/406

[58] Field of Search ..... 2/78 B, 78 A, 78 R, 2/109, 406, 400, 401, 402, 407, 403, 78 C

[56] References Cited

U.S. PATENT DOCUMENTS

| | | | |
|---|---|---|---|
| 737,975 | 9/1903 | Trimble et al. | 2/401 |
| 1,114,540 | 10/1914 | Segal | 2/401 |
| 2,190,425 | 2/1940 | Hurd | 2/401 |
| 2,651,047 | 9/1953 | Emerson | 2/78 B |
| 2,717,388 | 9/1955 | Rutledge | 2/401 |
| 3,044,467 | 7/1962 | Campau | 2/46 |
| 3,486,507 | 12/1969 | Bregenzer et al. | 2/401 |
| 3,852,828 | 12/1974 | Silverstein | 2/401 |
| 3,909,847 | 10/1975 | Holt et al. | 2/2 |
| 4,229,835 | 10/1980 | Shaw | 2/406 |
| 4,488,317 | 12/1984 | Polsky | 2/401 |
| 4,785,480 | 11/1988 | Polsky | 2/401 |
| 4,880,424 | 11/1989 | Rautenberg | 2/401 |

*Primary Examiner*—Werner H. Schroeder
*Assistant Examiner*—Amy Brooke Vanatta
*Attorney, Agent, or Firm*—A. Ray Osburn

[57] ABSTRACT

A crotch construction for a garment of pliable fabric which prevents the bunching of the fabric into the median cleft of the body in the crotch area. A barrier piece of relatively heavy, non-stretch material is sewn to a strip attached at its edges to the cloth of the garment, so as to float over the cleft and prevent folds of the cloth of the garment from entering and bunching therein.

10 Claims, 3 Drawing Sheets

GARMENT WITH BIND-PREVENTING CROTCH CONSTRUCTION

BACKGROUND OF THE INVENTION

1. Field

The field of the invention is garments to be worn on the body, including portions covering the buttock and crotch regions, and, more particularly, crotch constructions for such garments.

2. State of the Art

Garments for beach, dancing, exercise and similar highly active use are widely constructed of highly stretchable very lightweight material referred to as "stretch", "doublestretch", "spandex", and the like. Such cloth is normally woven from various synthetic textile elastic fibers that are long-chain polymers with a high percent of a segmented polyurethane, for example. Typically, the material stretches very freely to be highly formfitting without associated excessive tightness and discomfort. The same free stretch characteristics enables the material to easily give to accommodate relative motions of body parts without binding. However, the stretchability has in the crotch and buttock area lead to uncomfortable persistent bunching of the material into the median cleft of the body. The problem of discomfort in this area exists with lightweight nonstretchable materials also. Various clothing constructions have been proposed which provide comfort in the female buttock and crotch area. Examples include U.S. Pat. Nos. 4,880,424, 3,852,828, 3,909,847, 3,044,467 and 2,717,388. The disclosed solutions principally provide garment crotch softness by use of padding, or improved body formfit by garment cut and proportioning. None address the cleft bunching problem to which many garments, especially those of the highly elastic stretch fabrics, are prone.

There remains a need for construction of garments of stretch fabrics and other materials in the crotch and buttock area which permits the utilization of desirable materials without concomitant bunching and chafing.

BRIEF SUMMARY OF THE INVENTION

With the foregoing in mind, the present invention eliminates or substantially alleviates the foregoing disadvantages in prior art active garment construction by providing a garment incorporating a structure which prevents the bunching of the material of the garment into the median cleft of the crotch and buttocks. The construction provides a barrier to prevent entry of folds of the garment material into this cleft. The barrier comprises a small bridge of nonstretch cloth laterally spanning a portion of the cleft on the inside of the garment. The barrier is mounted generally centrally upon a somewhat larger piece of flexible fabric attached to the inside of the cloth of the garment. Generally, the mounting piece is an elongate front to rear strip. Although other shapes may be employed if desired, the term "median strip" is used hereinafter.

The median strip is attached to the garment only along its periphery, attachment at only front and rear ends, or only along both sides is generally sufficient, although the strip may be attached around its entire periphery.

When the garment is worn, the material of the barrier is selected so that it is not itself drawn deeply into the cleft and so that it effectively also excludes the garment material therefrom. During active use of the garment, the seat and crotch material remains free to follow and adapt to the relative motions of the buttock, abdomen and thighs. The barrier, however, remains over the cleft, not dislodged because of the flexibility of the attached median strip. To be effective, the barrier may be selected to be less pliable, or more bulky, or both, than the adjacent garment material.

The garment may include a roughly diamond shaped crotch panel, sewn to span between the front and the back panels of the garment, and tapered to meet the upper ends of the left and right leg inseams. This crotch panel is known as a "gusset", and typically serves to provide room to accommodate the buttocks. In garments incorporating such gussets, the ends of the median strip may be conveniently sewn to front and rear gusset edge seams. However, the garments may have differently shaped gussets, or none at all.

It is therefore the principal object of the invention to provide a form-fitting garment constructed in the crotch and buttock area to prevent the garment material from migrating into and bunching within the median cleft of the crotch and buttocks.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
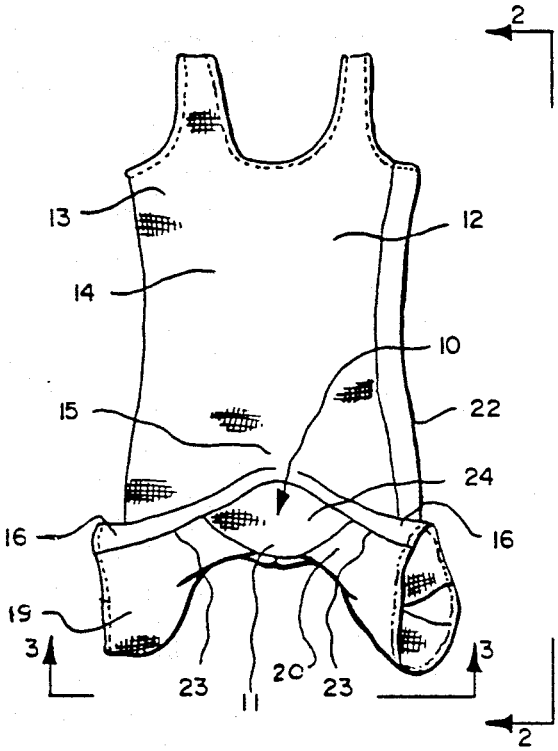
FIG. 1 is a front elevation view of a garment in accordance with the invention, incorporating a bind-preventing crotch construction, the crotch and leg inseam area being folded outward and upward to reveal the outside of the crotch area in detail, drawn to a reduced scale.
Figure 2:
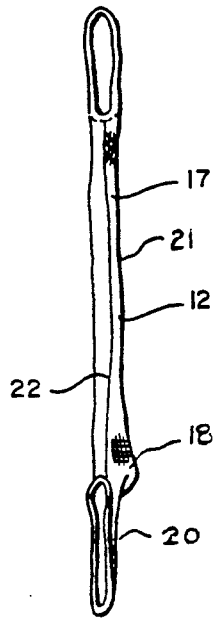
FIG. 2 is an elevation view of the garment of FIG. 1, taken along line 2—2 thereof, drawn to the same scale.
Figure 3:
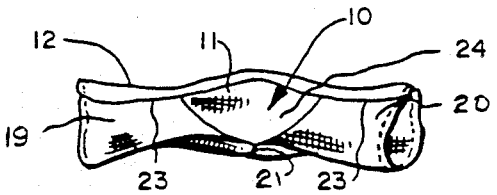
FIG. 3 is a bottom view of the garment of FIG. 1, taken along line 3—3 thereof, drawn to the same scale, FIG. 4 an elevation view of a bottom fragment of the garment of FIG. 1, said garment however being shown as reversed, inside out, with the leg inseam and crotch area folded to show the inside of a crotch area and the floating barrier of the inventive bind-preventing crotch construction, drawn to the scale of FIG. 1, FIG. 5 a rear elevation view of the garment of FIG. 1, said garment however being shown in its general shape when worn upon the body, drawn to the same scale, FIG. 6 a view of a fragment of the garment of FIG. 4, showing a bind-preventing crotch construction as seen from inside of the garment, with the barrier mounting median strip partially cut away to reveal a portion of the barrier strip thereunder, drawn to a substantially larger scale than that of FIG. 4, FIG. 7 a cross sectional view of the fragment of FIG. 6, taken along line 7—7 thereof, drawn to the same scale, FIG. 8 a view of a fragment of a garment incorporating a bind-preventing crotch construction seen from the inside of the garment, said garment however being constructed without the gusset of garments of FIGS. 1–7, drawn to approximately the scale of FIG. 6.
Figure 4:
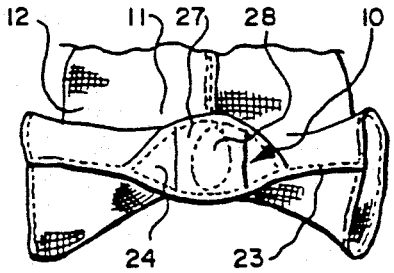
Figure 5:
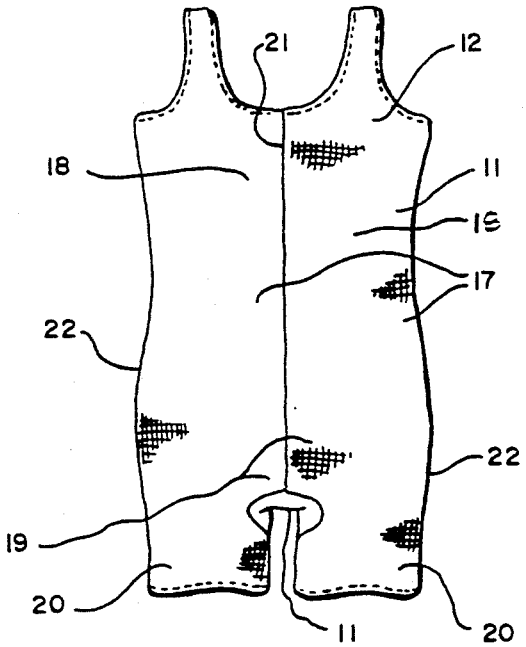
Figure 6:
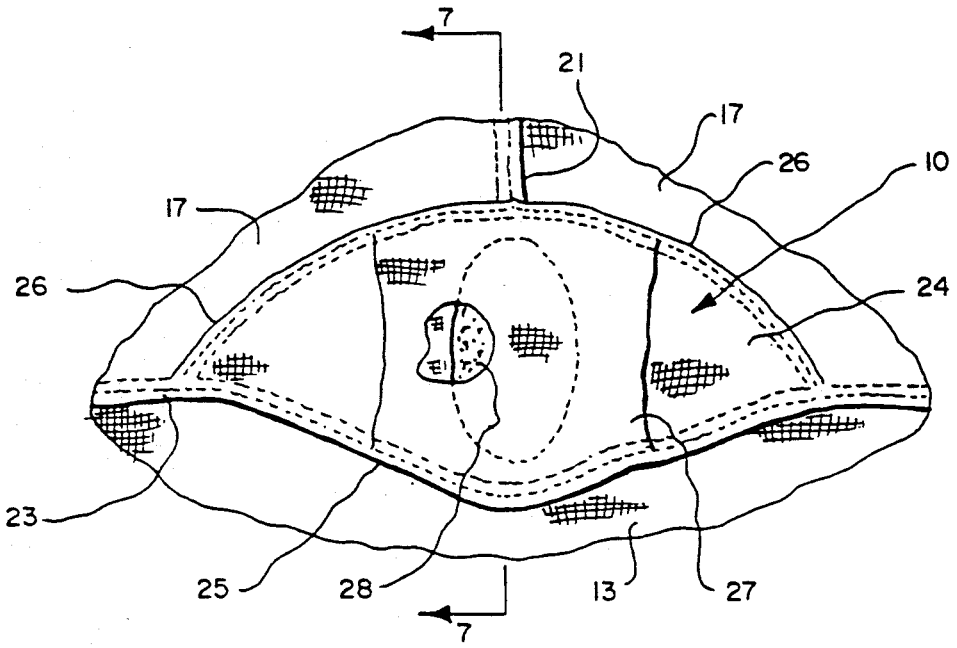
Figure 7:
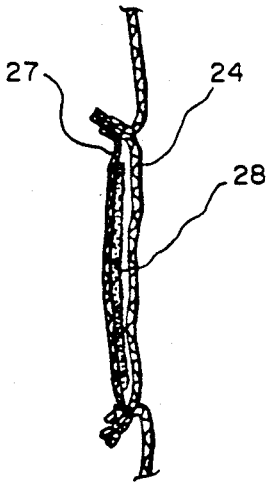

In FIGS. 1-7, a garment 10 with a bind-preventing crotch construction 11 is shown incorporated into the crotch 12 of a females' beach playsuit constructed of stretch cloth. Garment 10 comprises a cloth panel 13 forming the front torso 14, abdomen 15 and front leg portions 16. A pair of panels 17 provide upper back, buttock and rear leg potions 18, 19 and 20 respectively.

Rear panels 17 are joined together by a vertical seam 21, to the sides of front panel 13 by a pair of vertical side seams 22, and to the leg portions of front panel 13 by a pair of leg inseams 23.

At the crotch 12, a cloth gusset panel 24 spans between the lowermost ends of the pair of rear panels 17 and the front panel 13. Gusset 24 is secured by front and rear gusset seams 25 and 26 respectively, which join at the uppermost ends of the pair of leg inseams 23.

Crotch bind-preventing construction 11 comprises a median strip 27 of stretch material spanning the body side of gusset 24 from front to rear, with its rearmost and foremost ends sewn into corresponding gusset seams 26 and 25. A cleft bridging barrier strip 28 is sewn centrally onto median strip 27, preferably on the side thereof away from the body. Barrier strip 28 is of non-stretch but soft flexible material, to avoid chafing of the cleft area. To avoid being folded and drawn into the cleft, it must be substantially less pliable, more thick and bulky, or both, than the material of the garment. A heavy cloth needlepunch batt of medium polyster, thread-bonded fiber ⅛" to 3/16" thick, especially made by Hobbs Bonded Fibers of Groesbeck, Tex., has proven to be sufficiently flexible, soft and bulky to perform well when used in elongate elliptical form or the like about 2 ¾ inches long and 1 ⅝ inches wide. This material comprises a matt of the fibers everywhere bound together by closely spaced stitches of the thread therethrough. Other advantageous characteristics of this particular material are porosity and washability. Other materials may of course also prove satisfactory.

Barrier strip 28 is mounted entirely upon substantially larger median strip 27, so that it is connected to garment 10 only by substantial free lengths of very flexible stretch material. This permits the buttock, rear leg and gusset portions 19, 20 and 24 to move actively with the body while barrier 28 remains bridged over the median cleft. This prevents entry, bunching and binding of folds of garment stretch material into the median body cleft.

Neither median strip 27 nor barrier strip 28 need extend to cover the entire median cleft of the body. It has been found that bunching is effectively prevented when barrier 28 is centered approximately upon the foremost end of the buttock median cleft. A barrier strip 28 of the abovementioned dimensions is sufficient to prevent binding by covering this critical portion of the crotch 12 of most teenage and adult females. Larger barriers 28 would be unnecessarily bulky, and perhaps even visible and unsightly from the exterior of the garment.

Figure 8:
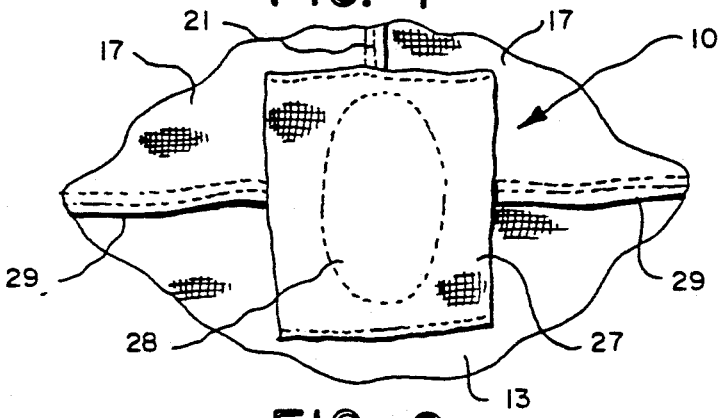

The above described garment 10 desirably includes the gusset 24, providing crotch looseness and improving fit in this area. Conceivably, however, another garment could be constructed without gusset 24, by, for example, extending and shaping the bottoms of front and rear panels 13 and 17 so that they may be joined at the bottoms by a single continuous inseam 29 for both the legs and the crotch. (FIG. 8)

Bind-preventing device 11 may be employed for such alternate constructions of garments 10. To do so, median mounting strip 27 is sewn at each of its ends to the garment material of the front and the buttock portions 13 and 19, to place barrier 28 with respect to the body as described above. (FIG. 8)

Figure 9:
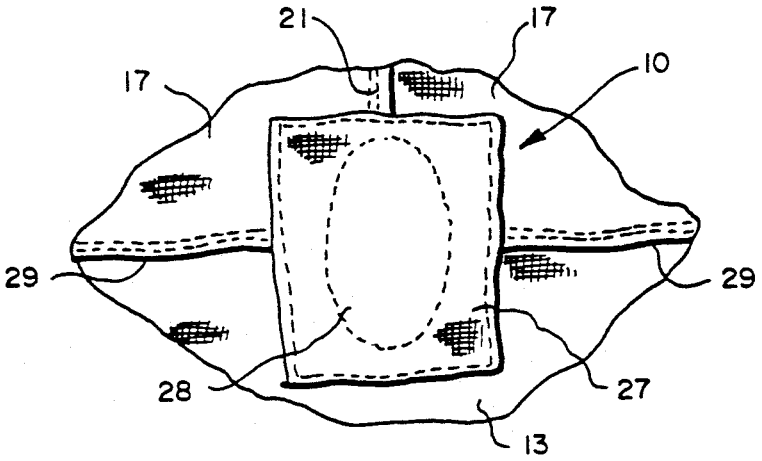
FIG. 9 a view of the garment of FIG. 8, the median strip thereof however being sewn to the garment about its entire periphery, drawn to the scale of FIG. 8, and FIG. 10 an elevation view of a bottom fragment of a legless garment in accordance with the invention, shown as reversed, inside out, folded to show the inside of the crotch area and the floating barrier of the inventive bind-preventing crotch construction, drawn to a larger scale than that of FIG. 1.
Figure 10:
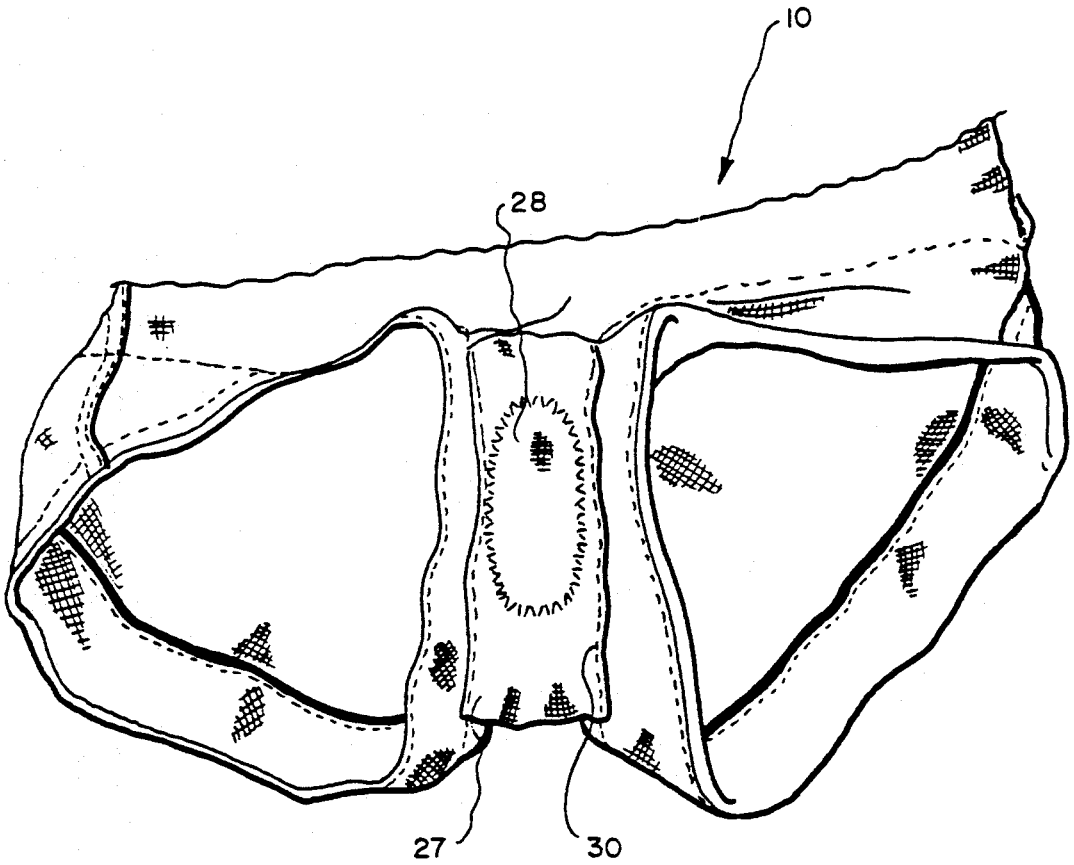

Median strip 27 may be attached other than at front and rear ends or described above. In FIG. 10, median strip 27 is illustrated sewn front to rear along its sides to leg opening seams 30 of a legless swim suit 10. Median strip 27 may be secured about its entire periphery, whether or not a gusset is involved, but is generally avoided as unnecessary. (FIG. 9)

While the crotch binding problem is especially severe in active wear garments of the stretch materials, the scope of the invention also includes use in active wear garments of other materials. Garments of conventional weaves of cotton, wool, silk, linen and the like often have the crotch infolding problem, and bind-preventer construction 11 is no less effective than with garments of material characterized as stretch, double-stretch, double-knit, spandex, stretch denim, and the like. Nor is the invention limited to the use of stretch material for median strip 27, since barrier strip 28 could be floated upon any thin flexible material with a considerable degree of bind-preventing success.

The scope of the invention includes application to garments for male as well as female wear.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A garment of cloth material, comprising:

a buttock and crotch portion constructed of flexible cloth; and a bind-preventing structure, including;

a median strip of pliable material secured to an inside of the buttock and crotch portion, extending from front to rear thereupon, placed to extend along and across at least a portion of the median cleft of a body of a wearer of the garment, said strip having a periphery with opposing foremost and rearmost portions and opposing side portions, and being secured to the inside of the buttock and crotch portion only along a pair of opposing segments of the periphery thereof selected from the group consisting of a pair comprising a rearmost and a foremost segment and a pair comprising two opposing side segments; and a barrier structure having sides defined by edges, said barrier structure secured to the median strip and extending therealong from front to rear to bridge across at least a portion of the median cleft of the body of the wearer, said structure to be constructed of non-elastic cloth material to be sufficiently less pliable than the cloth of the buttock and crotch portion to prevent the cloth of the buttock and crotch portion from entering into said median cleft; wherein the median strip extends substantially outward beyond the edges of the barrier at least toward the secured portions of the periphery thereof.

2. The garment of claim 1, wherein:

the median strip extends substantially outward beyond the edges of the barrier on all sides thereof.

3. The garment construction of claim 1, wherein:

the crotch and buttock portion includes a gusset seamed to front and rear portions of the buttock and crotch portion of the garment; and the median strip is secured at its rearmost and foremost ends to the front and rear seams of the gusset.

4. The garment of claim 1, wherein the barrier comprises:

a cloth material of synthetic, thread-bonded fiber.

5. The garment of claim 2, wherein the barrier comprises:

a cloth material of synthetic, thread-bonded fiber.

6. The garment of claim 3, wherein the barrier comprises:

a cloth material of synthetic, thread-bonded fiber.

7. The garment of claim 6, wherein:

the flexible cloth of the buttock and crotch portion is selected from the group consisting of highly elastic fabrics, stretch material, double-stretch material, spandex material, double-knit material, cotton and wool weaves, and weaves of non-elastic synthetic fibers.

8. The garment of claim 1, wherein:

the barrier structure comprises a cloth structure which is less pliable than the cloth of the median strip, wherein said cloth structure is comprised of a cloth selected from the group consisting of cloth of lesser pliability than that of the cloth of the median strip and of comparable thickness thereto, cloth of comparable pliability to that of the cloth of the median strip, incorporated in greater thickness than the thickness thereof, and cloth of lesser pliability than that of the cloth of the median strip, incorporated in greater thickness than the thickness thereof.

9. The garment of claim 1, wherein:

the flexible cloth of the buttock and crotch portion is selected from the group consisting of highly elastic fabrics, stretch material, double-stretch material, spandex material, double-knit material, cotton and wool weaves, and weaves of non-elastic synthetic fibers.

10. The garment of claim 9, wherein:

the barrier structure comprises a cloth structure which is less pliable than the cloth of the median strip, wherein said cloth structure is comprised of a cloth selected from the group consisting of cloth of lesser pliability than that of the cloth of the median strip and of comparable thickness thereto, cloth of comparable pliability to that of the cloth of the median strip, incorporated in greater thickness than the thickness thereof, and cloth of lesser pliability than that of the cloth of the median strip, incorporated in greater thickness than the thickness thereof.

* * * * *